US006505720B1

(12) United States Patent
Tsai

(10) Patent No.: US 6,505,720 B1
(45) Date of Patent: Jan. 14, 2003

(54) WHEELED LUGGAGE

(76) Inventor: James Tsai, No. 103, Ta-Ming 1 Rd., Tung Pao Village, Tan Tzu Hsian, Taichung Hsien (TW)

( * ) Notice: Subject to any disclaimer, the term of this patent is extended or adjusted under 35 U.S.C. 154(b) by 0 days.

(21) Appl. No.: 09/906,793

(22) Filed: Jul. 18, 2001

(51) Int. Cl.[7] ..... A45C 13/00

(52) U.S. Cl. ..... 190/115; 190/127; 190/18 A; 190/103; 224/153

(58) Field of Search ..... 190/18 A, 115, 190/122, 127; 224/153

(56) References Cited

U.S. PATENT DOCUMENTS 5,022,574 A * 6/1991 Cesari ..... 190/18 A X
5,649,658 A * 7/1997 Hoffman et al. ..... 190/2 X
5,749,503 A * 5/1998 Wulf et al. ..... 190/18 A X
D402,463 S * 12/1998 Mettler ..... D3/279
5,908,093 A * 6/1999 Miyoshi ..... 190/115
5,918,710 A * 7/1999 Sher ..... 190/115 X
5,984,154 A * 11/1999 Scicluna ..... 190/18 A X
6,164,509 A * 12/2000 Gausling et al. ..... 224/627
6,179,176 B1 * 1/2001 Saggese et al. ..... 190/18 A X
6,279,706 B1 * 8/2001 Mao ..... 190/18 A X
6,289,554 B1 * 9/2001 Wang ..... 190/18 A X

* cited by examiner

*Primary Examiner*—Nathan J. Newhouse
(74) *Attorney, Agent, or Firm*—Browdy and Neimark, P.L.L.C.

(57) ABSTRACT

A wheeled luggage comprises: A soft bag, having a bottom side wall, a top side wall, a first side wall, a second side wall and two lateral side walls. A frame body, comprising a base frame and a supporting frame. The frame body fixed on the bag by the base frame of the frame body fixing on the bottom side wall of the bag and the supporting frame of the frame body fixing on the first side wall of the bag. Two carrying belt, provided on the second side wall of the bag. Two wheels pivoted at the bottom side of the frame body for free rotating. A retractable assembly, having one end provided at the supporting frame of the frame body for extending and collapsing, and a handle provided at the outer end of the retractable assembly.

15 Claims, 9 Drawing Sheets

WHEELED LUGGAGE

FIELD OF THE INVENTION

The present invention relates to a luggage case and, more particularly, to a wheeled luggage.

FIG. 1 shows a conventional wheeled luggage, which comprises a rectangular frame body 70, which supports the luggage in shape, a flexible fabric covering covered on the frame body 71 to form side walls 72 and 73 of the luggage. The flexible fabric covering defines a storage space 74 for holding goods, clothes, and etc. One outside wall 72 has a zipper 721, which controls the entrance of the storage space 73. The luggage comprises two wheel assemblies 75 at the bottom side, a handle 76 at the center of the top side, and a retractable handle 77 near the rear side.

The inventor finds the structure of wheeled luggage disclosed above having some disadvantages:

1. When the user carrying the luggage, the front side wall 72 is a soft cloth. So that the goods stored in the storage space 73 are easy to be damaged by unexpected force.

2. The retractable handle 75 located at the rear side wall 73 of the luggage, when the user carrying the luggage by hand or carrying it on back. The rigid retractable handle 75 will be against on human body and make the user uncomfortable.

3. The frame body 71 made the luggage 70 can't adjust the size of the storage space 74. Although there were some solutions to adjust the size of the storage space of a luggage in prior art. But the disclosed adjusting mechanism is complex and not easy to operate.

SUMMARY OF THE INVENTION

The primary objective of the present invention is to provide a wheeled luggage, which is free from the drawbacks described above.

In keeping with the principle of the present invention, the wheeled luggage of the present invention comprises: A bag, having a bottom side wall, a top side wall, a first side wall, a second side wall and two lateral side walls. A frame body, comprising a base frame and a supporting frame. The frame body fixed on the bag by the base frame of the frame body fixing on the bottom side wall of the bag and the supporting frame of the frame body fixing on the first side wall of the bag. Two wheels pivoted at the bottom side of the frame body for free rotating. A retractable assembly, having one end provided at the supporting frame of the frame body for extending and collapsing, and a handle provided at the outer end of the retractable assembly.

BRIEF DESCRIPTION OF THE INVENTION

DETAIL DESCRIPTION OF THE INVENTION

Figure 1:
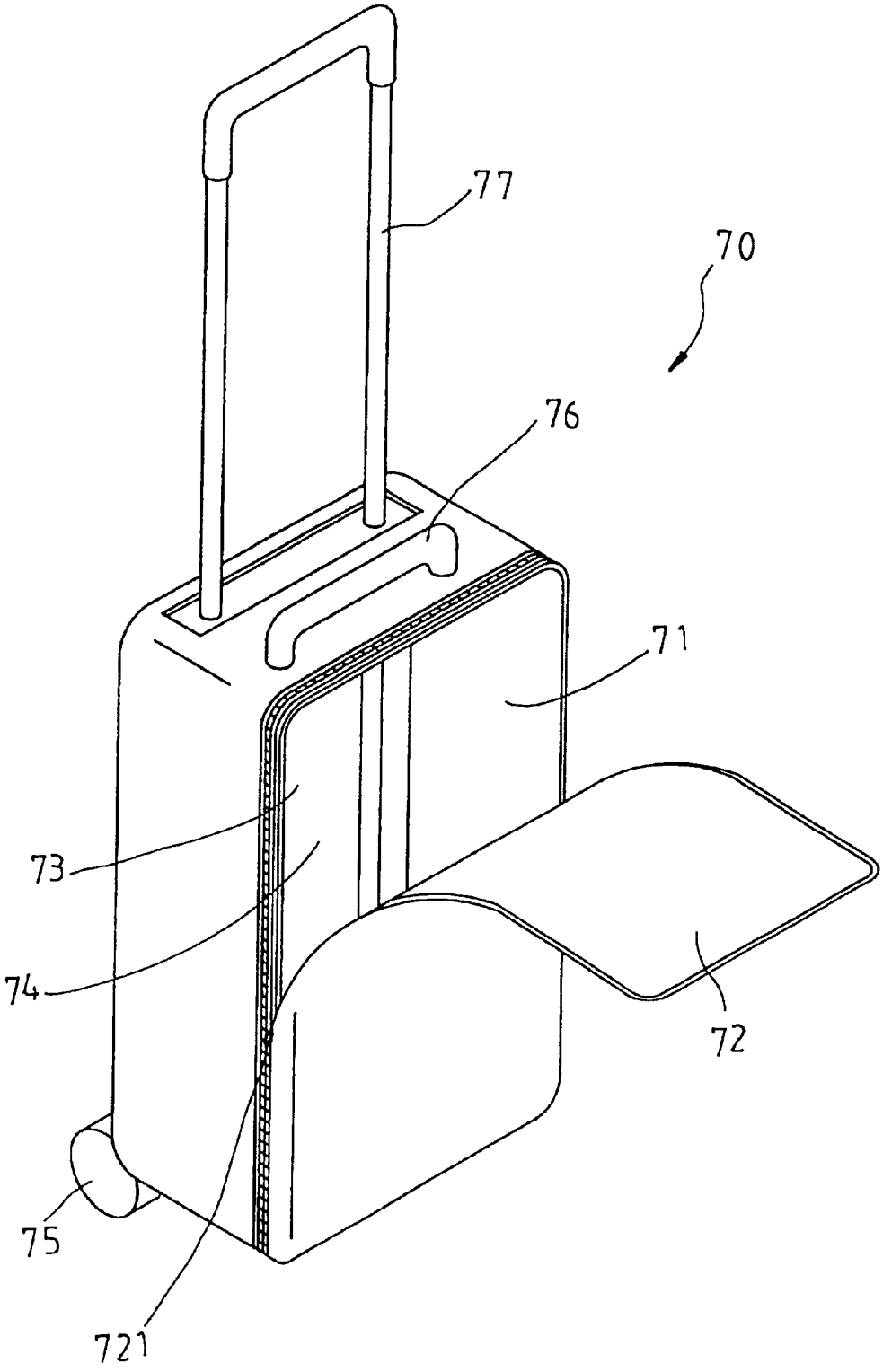
FIG. 1 PRIOR ART
FIG. 1 shows the structure of the wheeled luggage of prior art.

Please refer to FIG. 2 to FIG. 6, the wheeled luggage of the embodiment of the present invention comprises:

A soft bag 10, which has a bottom side wall 101, a top side wall 102, a first side wall 103, a second side wall 104 and two lateral side walls 105 and 106. The bottom and top side wall 101 and 102 are defined as the bottom side and top side of the bag 10. The first and second side wall 103 and 104 are defined as the front side and rear side of the bag 10, and the lateral side walls 105 and 106 are the left and right side of the bag 10. The top side wall 102 fixed with the second side wall 104, and connected to the first and the two lateral side walls 103, 105 and 106 with a zipper 12 to be the entrance of storing goods in the bag 10. The top side wall 102 also provides a bag handle 13 for user to grip. Two carrying belts 14 provided on the second side wall 104 for user to carry on back. Two elongated elastic pieces 15 and 16 respectively disposed in the lateral side walls 105 and 106 to provide the lateral side walls 105 and 106 a capacity of expanding the width thereof.

A frame body 20, which is made of a hard plastic plank with substantially a L shape in the cross side view. Wherein, the horizontal part of the frame body 20 is defined as a base frame 201, and the vertical part of the frame body 20 is defined as a supporting frame 202. The supporting frame 202 has an elongated handle seat 203 at the top end thereof. Two wheeled slots 21 disposed parallel on the flexure portion of the frame body 20 with two wheels 22 pivoted thereof respectively for free rotating.

The frame body 20 stitched on the bag 10 by the base frame 201 fixing on the bottom side wall 101 and the supporting frame 202 fixing on the first side wall 103. At this time, the outer end of the handle seat 203 be closing to the top end of the first side wall 103 of the bag 10. So that, the bag 10 will be supported by the frame body 20 in a predetermined shape. It has to be mention here, that the way of the frame body 20 fixed on the bag 10 also can be done by coherence, rivets or screws etc.

Figure 2:
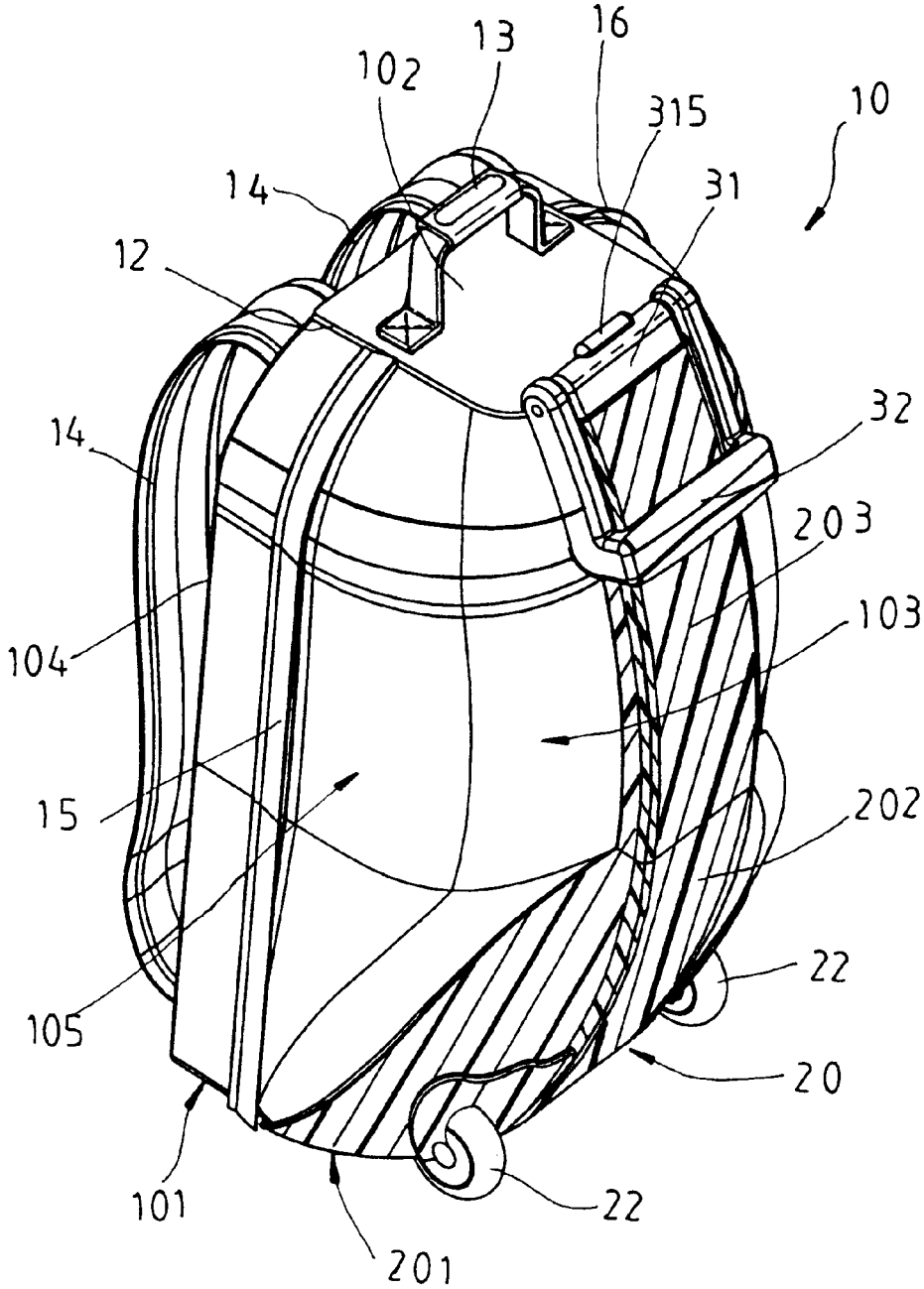
FIG. 2 shows a perspective view of the embodiment of the present invention, in which the retractable handle positioned at the collapsed position.
Figure 3:
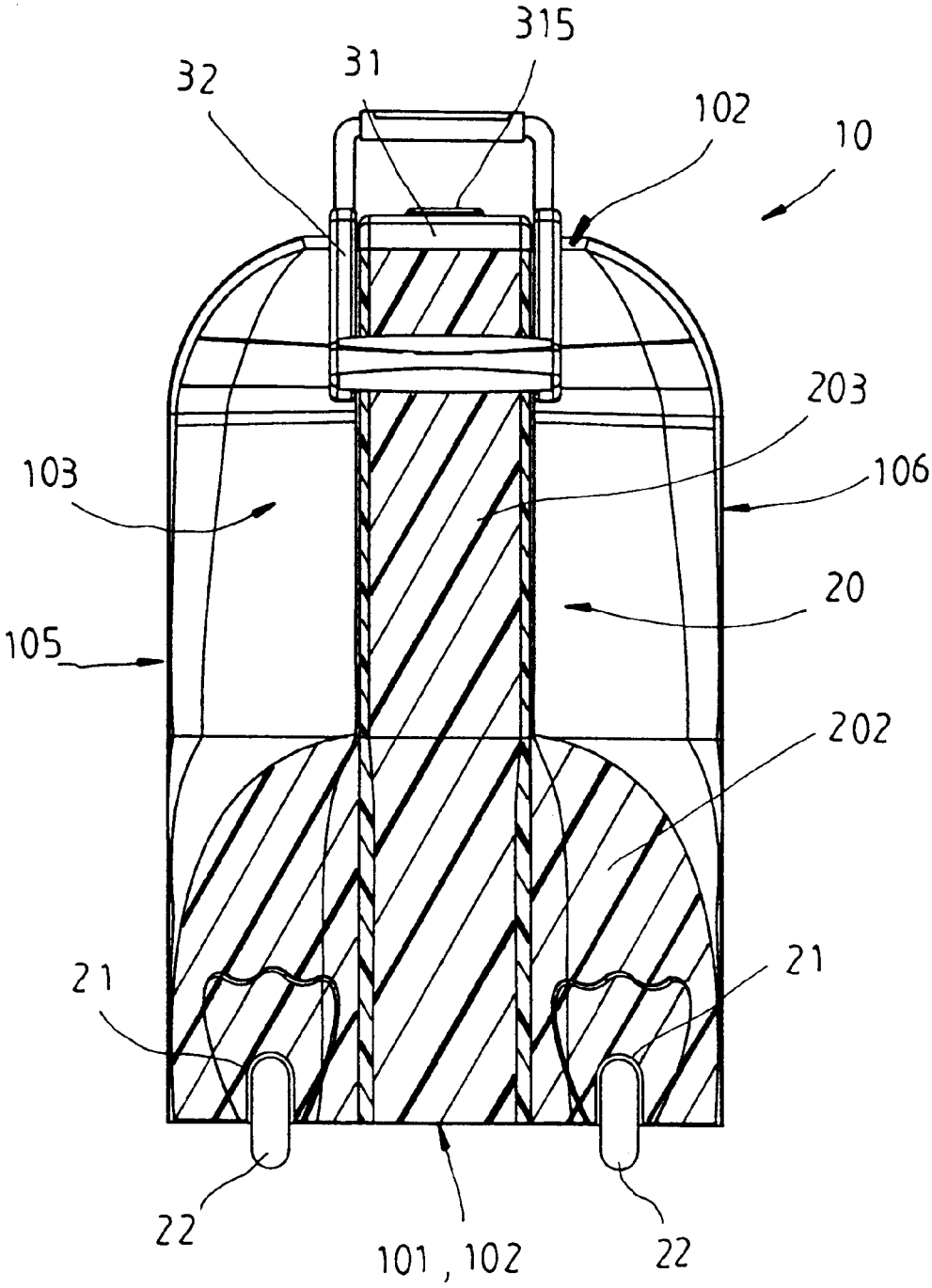
FIG. 3 shows a front view of he embodiment of the present invention.
Figure 4:
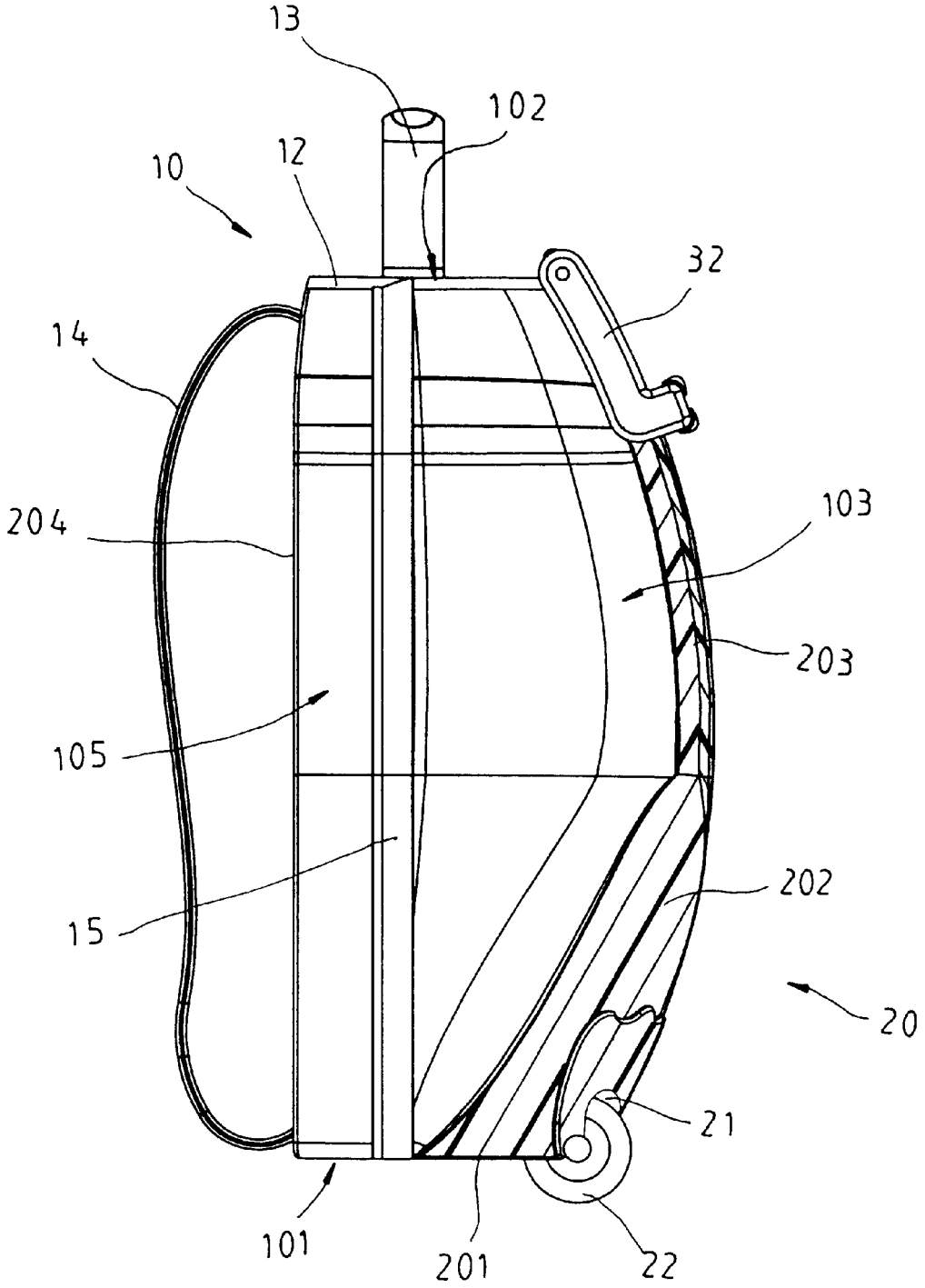
FIG. 4 shows a side view of he embodiment of the present invention.
Figure 5:
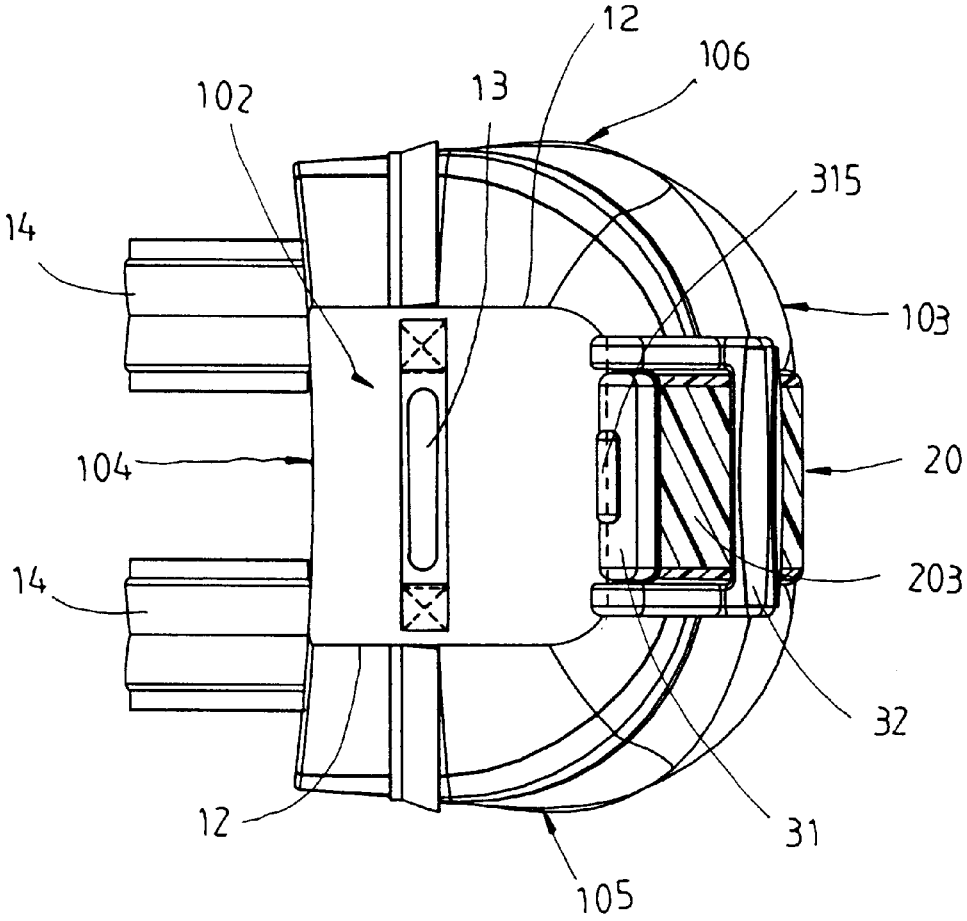
FIG. 5 shows a top view of he embodiment of the present invention.
Figure 6:
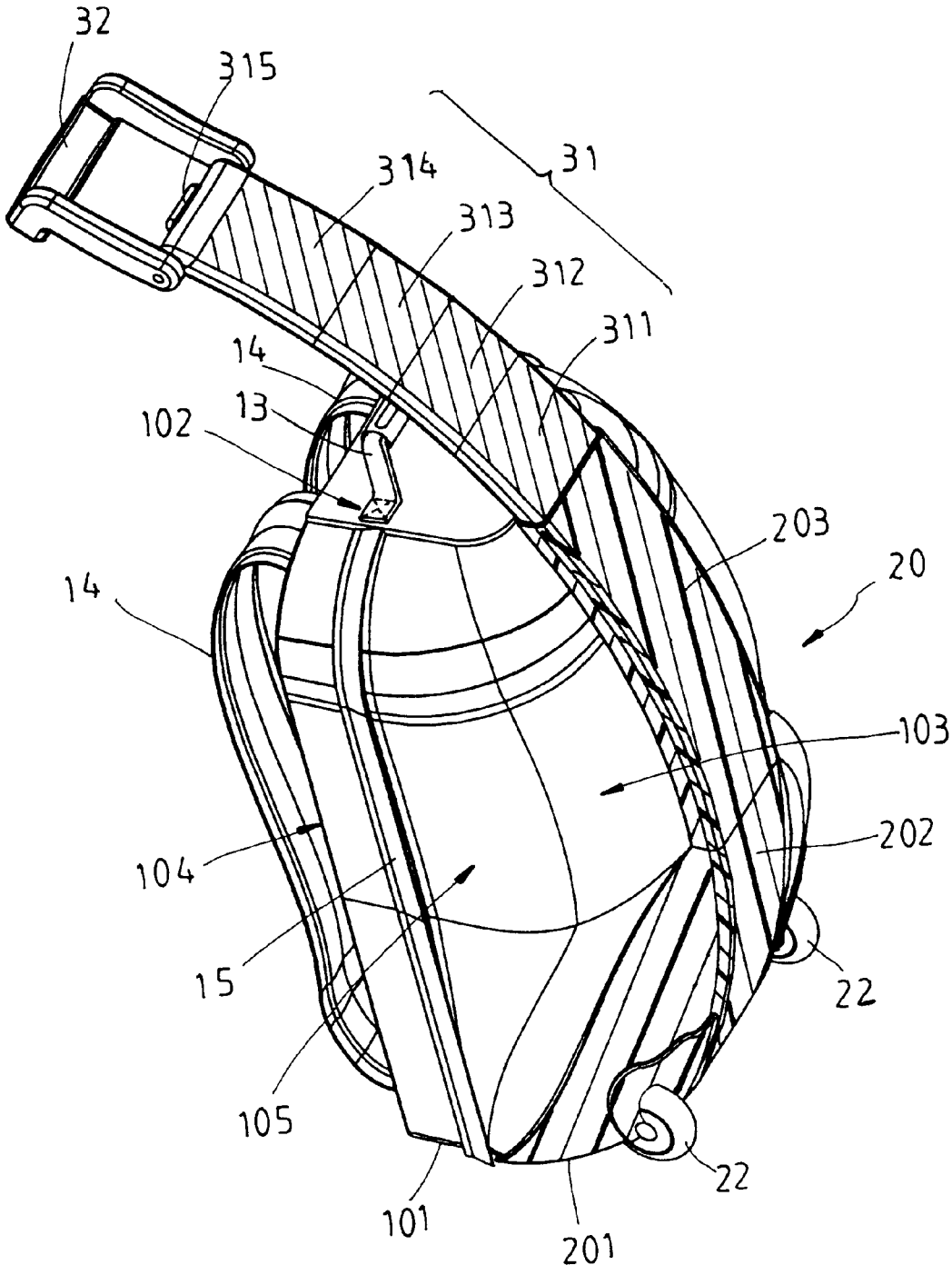
FIG. 6 shows a perspective view of the embodiment of the present invention, in which the retractable handle positioned at the extended position.

A rectangle assembly 31, please refer to FIG. 6, which has four segments 311, 312, 313 and 314. One of the segments 314 received in the handle seat 203 of the frame body 20, the other segments 311, 312 and 313 are installed in sequence. The segments 311, 312, 313 and 314 are curved and flat tubes of different sizes, so that the retractable assembly 31 will be a curved elongated tube when extended (as shown in FIG. 6), or collapsed to receive in the handle seat 203 (as shown in FIG. 2). And there was a control mechanism (not shown in figure) in the retractable assembly 31 for controlling the segments 311, 312, 313 and 314 to extend or collapse. The control mechanism is disclosed in a conventional retractable handle, please refer that for detail.

The retractable assembly 31 might be made of an elastic material, like metal, carbon fiber, glass fiber or composite material. The elastic material is made into an elongated strip and received in the handle seat 203 of the frame body 20. That would provide the same function for the embodiment of the present invention.

Figure 8:
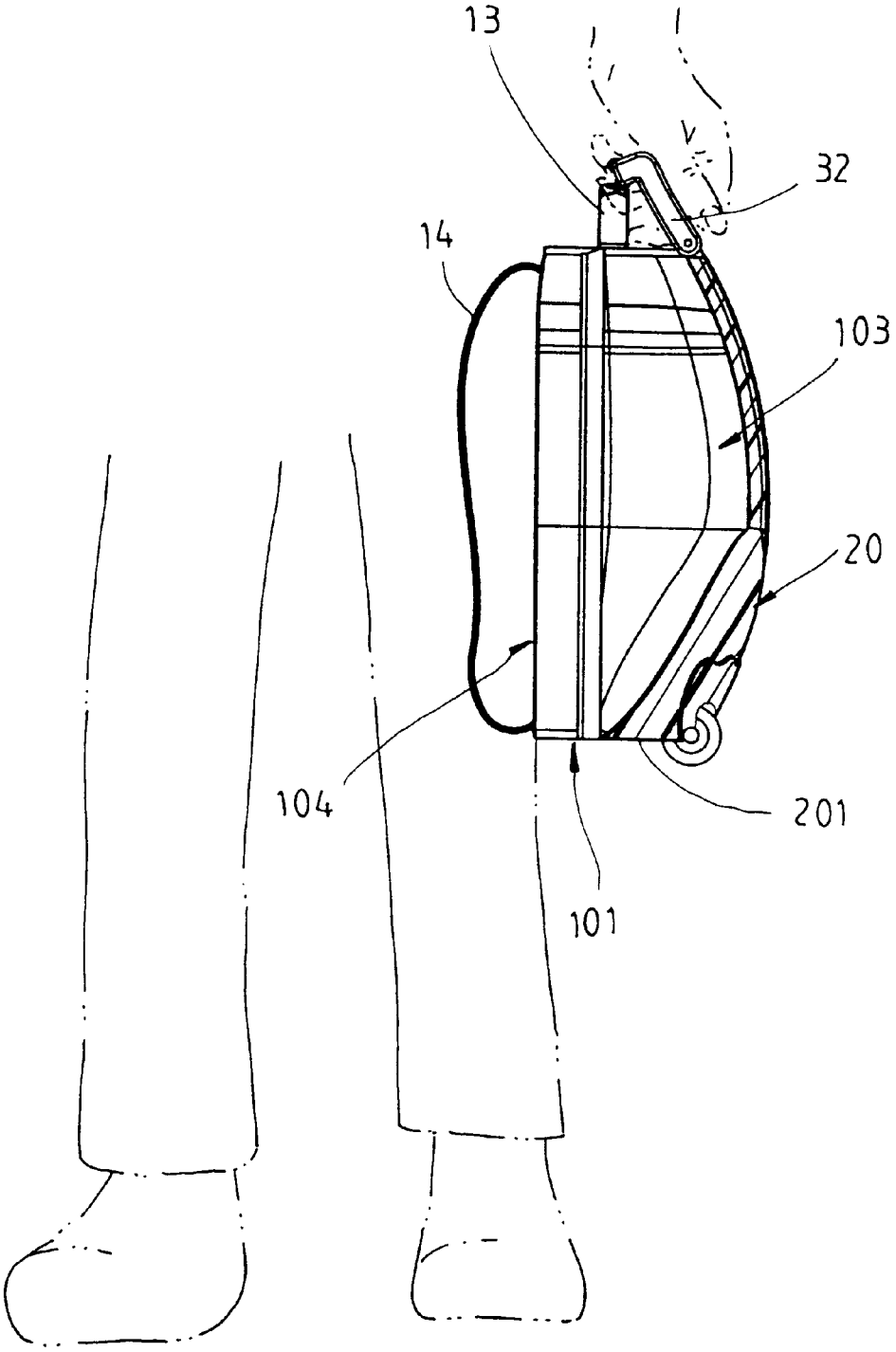
FIG. 8 is a schematic view showing the user carrying the wheeled luggage of the present invention by hand.

A handle 32 pivoted at the outer segment 311 of the retractable assembly 31. Inside the handle 32 has a spring (not shown) to provide the handle has an initial (collapsed) position of orientated downward shown in FIG. 2. The handle 32 can be turned by user to an operating position as shown in FIG. 8, in which the outer end of the handle 32 against on the bag handle 13 for user to grip both of the handle 32 and the bag handle 13 to carry the wheeled luggage of the present invention.

The wheeled luggage of the present invention has the advantages hereunder:

1. When user carry the wheeled luggage of the present invention, the supporting frame 202 of the frame body 20 located at the front side of the wheeled luggage. The rigid supporting frame 202 will protect the goods stored in the bag 10 from damaged by unexpected force.

Figure 7:
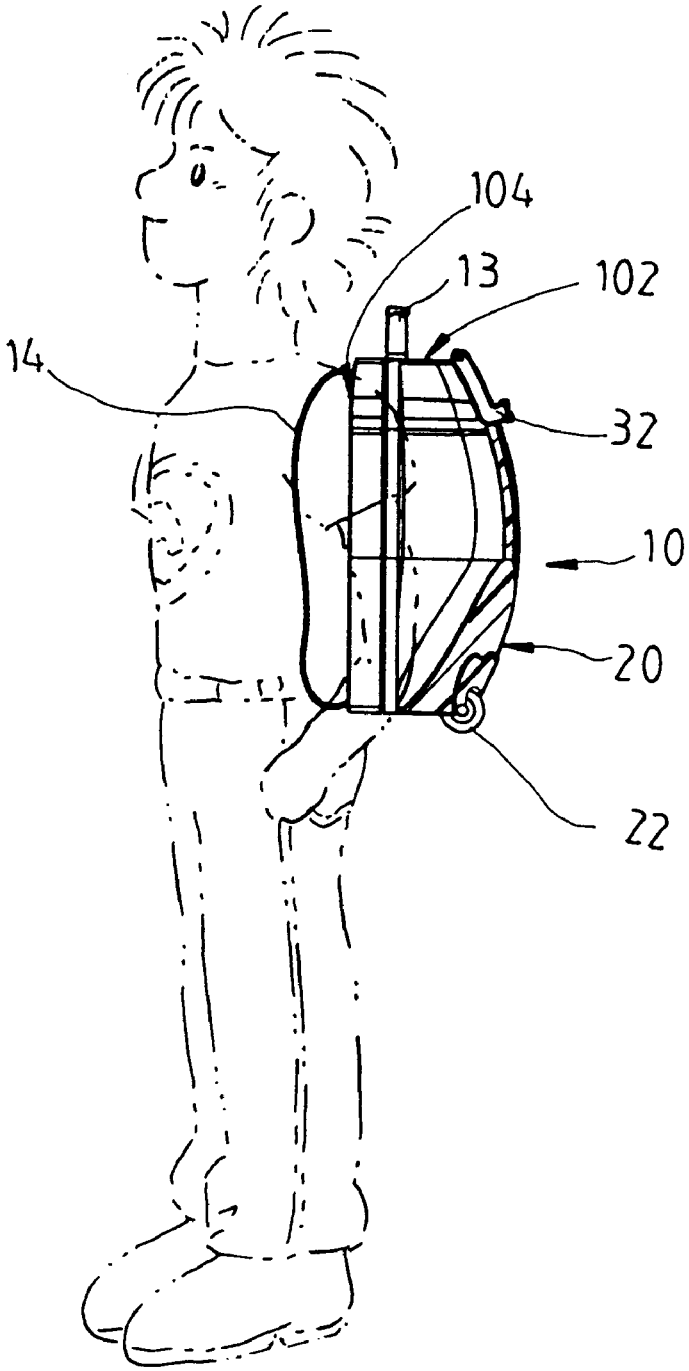
FIG. 7 is a schematic view showing the user carrying the wheeled luggage of the present invention on back.
Figure 9:
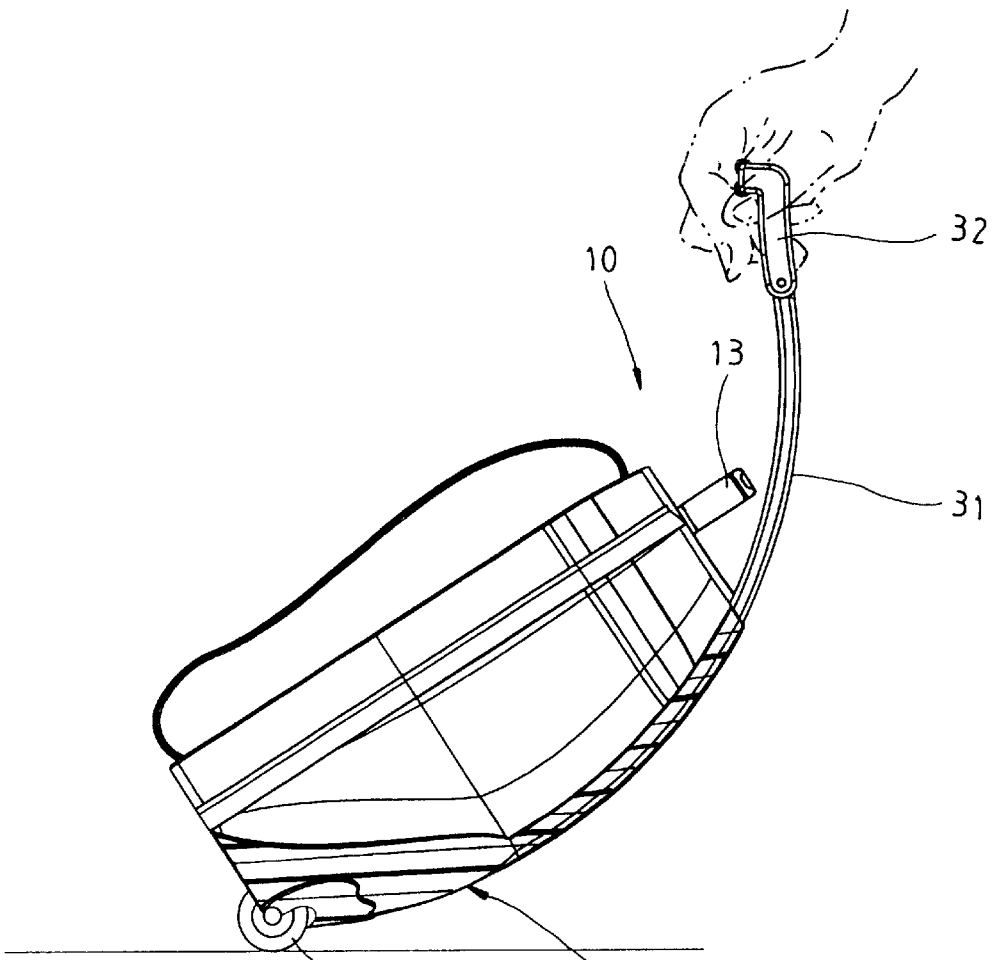
FIG. 9 is a schematic view showing the user pulling the wheeled luggage of the present invention to move on the ground.

2. User can carry the wheeled luggage of the present invention on back (as shown in FIG. 7), carry it by hand (as shown in FIG. 8) or pull it to move on the ground (as shown in FIG. 9). When the user carrying the wheeled luggage of the present invention on back or by hand, the second side wall 104 of the bag 10 is the surface being against the user. The soft second side wall 104 will provide the user more comfortable.

3. When user put too many goods in the bag 10, the elastic pieces 15 and 16 on the lateral side wall 105 and 106 will be expended to increase the widths of the lateral side wall 105 and 106 according to the sizes of the goods. The lateral side wall 105 and 106 will return to the original widths when taking some goods away. Which means the wheeled luggage of the present invention can provide a function of automatic adjusting the size of the bag 10.

What is claimed is:

1. A wheeled luggage comprising:

a soft bag having a bottom side wall, a top side wall, a front side wall, a rear side wall and two lateral side walls;

a frame body made from hard plastic having a base frame and a supporting frame; said base frame fixed on an exterior surface of said bottom side wall and said supporting frame fixed on an exterior surface of said front side wall;

two wheels pivoted on the bottom side wall for free rotation;

a retractable assembly having a first end engaged on said supporting frame, the retractable assembly being extendable from a collapsed position;

a handle provided on a second end of said retractable assembly;

wherein said base frame is substantially flat and said supporting frame is curved along the length of said front side wall and has one end engaged with said base frame in a predetermined angle; and wherein at least one carrying belt is provided on the rear side wall of the bag.

2. The wheeled luggage as defined in claim 1, wherein said frame body further has a handle seat on said supporting frame; said handle seat fixed on said front side wall of said bag; said retractable assembly being installed in said handle seat.

3. The wheeled luggage as defined in claim 1, wherein two elastic pieces extending from the bottom side wall to the top side wall are respectively provided in said lateral side walls to permit expanding a width of the lateral side walls.

4. The wheeled luggage as defined in claim 1, wherein a bag handle is provided on said top side wall.

5. The wheeled luggage as defined in claim 1, wherein said frame body has two parallel wheel slots at the bottom side thereof; said wheels being respectively received in said wheel slots.

6. The wheeled luggage as defined in claim 1, wherein said bag has at least one zipper thereof for opening and closing said bag.

7. The wheeled luggage as defined in claim 1, wherein said handle rotates on said retractable assembly downwards to a collapsed position and upwards to an operating position.

8. The wheeled luggage as defined in claim 7, wherein said bag further has a bag handle on said top side wall thereof; said handle resting on said bag before being turned to the operating position.

9. The wheeled luggage as defined in claim 1, wherein said retractable assembly is curved when extended.

10. The wheeled luggage as defined in claim 9, wherein said retractable assembly comprises a plurality of curved segments.

11. The wheeled luggage as defined in claim 1, wherein the bag is formed from soft material.

12. A wheeled luggage comprising:

a soft bag, having a bottom side wall, a top side wall, a front side wall, a rear side wall and two lateral side walls;

a frame body, made from hard plastic having a base frame and a supporting frame, said base frame fixed on an exterior surface of said bottom side wall and said supporting frame fixed on an exterior surface of said front side wall of said bag;

at least one carrying belt, provided on said rear side wall;

two wheels pivoted at the bottom side for free rotation;

a retractable assembly, having a first end engaged on said supporting frame, the retractable assembly being extendible from a collapsed position;

a handle provided at a second end of said retractable assembly; and wherein two elastic pieces extending from the bottom side wall to the top side wall are respectively provided on said lateral side walls of said bag to permit expanding a width of the lateral side walls.

13. The wheeled luggage as defined in claim 12, wherein said base frame is flat and said supporting frame is curved and has one end engaged to said base frame in a predetermined angle.

14. The wheeled luggage as defined in claim 13, wherein said frame body further has a handle seat engaged to said supporting frame; said handle seat being fixed on said front side wall with said retractable assembly installed in said handle seat.

15. The wheeled luggage as defined in claim 12, wherein the bag is formed from soft material.

* * * * *